US006193598B1

(12) United States Patent
Tsuchida

(10) Patent No.: US 6,193,598 B1
(45) Date of Patent: Feb. 27, 2001

(54) SIZE CHANGEABLE HOPPER

(75) Inventor: Tamotsu Tsuchida, Iwatsuki (JP)

(73) Assignee: Asahi Seiko Kabushiki Kaisha (JP)

( * ) Notice: Subject to any disclaimer, the term of this patent is extended or adjusted under 35 U.S.C. 154(b) by 0 days.

(21) Appl. No.: 09/315,608

(22) Filed: May 20, 1999

(30) Foreign Application Priority Data

May 21, 1998 (JP) ..... 10-177975
Dec. 4, 1998 (JP) ..... 10-376428

(51) Int. Cl.[7] ..... G07D 1/00
(52) U.S. Cl. ..... 453/57; 221/241
(58) Field of Search ..... 453/13, 33, 57; 221/241; 222/305, 307

(56) References Cited

U.S. PATENT DOCUMENTS 1,369,862 * 3/1921 White ..... 221/241
1,979,659 11/1934 Zierick .
5,122,094 6/1992 Abe ..... 453/57
5,711,704 * 1/1998 Hughes et al. ..... 453/57
5,924,919 * 7/1999 Hirano ..... 453/57

FOREIGN PATENT DOCUMENTS

548216 * 1/1958 (IT) ..... 453/13
6-44305 6/1994 (JP) .

* cited by examiner

*Primary Examiner*—F. J. Bartuska
(74) *Attorney, Agent, or Firm*—McGlew and Tuttle, P.C.

(57) ABSTRACT

A simplified coin hopper structure which facilitates coin size changes. The coin hopper equipment is easily applied to various coin sizes by simple adjustments. The device includes a tank for storing coins in a loose loading condition and a disk arranged rotatably at the inside bottom of the tank. One or more hole, for passage of coins, is provided through the disk. An adjustment element is provided on this disk to open and close the hole and to form an adjustable opening for different coin sizes. A base for the disk is arranged below the disk. A rotating element turns the disk. A gear train is provided at the base connecting a drive to the rotating element.

16 Claims, 10 Drawing Sheets

SIZE CHANGEABLE HOPPER

FIELD OF THE INVENTION

This invention relates to coin hopper equipment, i.e. a device storing a plurality of coins with a small disk shape and for sending out the coins and more particularly to coin hopper equipment to store a plurality of the same kind of coins with loose loading conditions and to release the coins one by one. Furthermore, this invention relates to a coin hopper equipment in which it is possible to change the size according to the kind of coin, e.g. according to the size of the coin. The terminology 'coin' which is used in this specification is intended to include small disks such as a coin which is coinage as well as a medal, a token or the like used for games.

BACKGROUND OF THE INVENTION

Various types of equipment to handle coins are known including devices which include a disk. For example, coin hopper equipment is known which accommodates coins of an identical kind with loose loading conditions, and turns a disk and compulsorily sends out the coin one by one. This type coin hopper is disclosed, for example, in the Japanese Patent Application 2-152852 assigned to the assignee of this invention (Japanese Patent Application 2-152852 has been designated Japanese Patent Application 6-44305 and also Japanese Patent Application 2-152852 corresponds to U.S. Pat. No. 5,122,094).

FIGS. 9 and 10 and 11 roughly show generally features from the prior art. The operation of such coin hopper equipment is summarily explained here.

When an electric motor (not shown) in the hopper equipment is driven, a turn axis 12 at the center is rotated. When the turn axis 12 is rotated, a disk 2 for coin distribution (a deep plate shaped element) is turned to the clockwise direction. Further, the coin distributing disk 2 which is turned to the clockwise direction is rotated at the inside bottom of tank 1 with rough pan shape. By the turn of this disk 2, coins in the dram-shaped disk 2 are agitated.

The coins are agitated by the protruding elements 6, which are formed at the inside surrounding wall 4 of disk 2. Thus, the coins in disk 2 fall into a plurality of holes 5 for coin receipt. These holes 5 are opened at the bottom of disk 2 and in the surrounding direction. The coin, which passed into this receiving hole 5 is moved in a sliding manner on the surface of a square support board 11 by the disk 2. As a result, the lowest position coin which slides is compulsorily sent out to a vent 23 providing the coin outlet. This is shown at the left side of FIG. 9.

The lowest position coin is moved by a coin sending nail (not shown) which is formed as a slender member and at the underside of disk 2. The moved lowest position coin is guided, for example, firstly by a guiding board 15 on the surface of support board 11. Then, for example, the coin is guided next by a flange surrounding wall 22 for installing the tank 1 and is slipped to the vent 23. The coin which is moved by the sending nail 13 (See FIG. 11) is guided by the guiding board 15 and flange surrounding wall 22 of tank 1.

The guided coin is further moved and is guided toward the coin vent 23 by the flange surrounding wall 22 and a vent guiding part 17. Then, finally, the coin is guided by the vent guiding part 17, a fixed side roller 24 and a mobile side roller 26 and is distributed out from the vent 23.

SUMMARY AND OBJECTS OF THE INVENTION

It is the primary object of the invention to simplify the structure of a coin hopper and to facilitate the change of coin sizes and to avoid the problems of past equipment to send out only the same kind of coins without making it possible to change over to other kinds of coins in a simple manner.

It is a further object of the invention to simplify the structure of coin hopper equipment and to easily apply the equipment to various coin sizes by simple adjustments.

According to the invention a coin hopper is provided which involves simple structure that can provide a size change simply even if it changes the coin kind. The size change-able coin hopper includes a tank container for storing coins in a loose loading condition. A disk is arranged rotatably at the inside bottom of this tank and has a pierced hole for falling coins. An adjustment device is provided on this disk to open and close the pierced hole and, for forming an adjusting hole for coin size.

A size change-able coin hopper may also provided according to the invention wherein the adjustment device has a circular board or circular plate with generally a cogwheel shape.

Also, this invention provides a size change-able coin hopper, characterized in that each tooth part of the adjustment structure opens and closes the pierced hole and forms the adjustment hole.

The coin hopper equipment may include a base and a disk which is arranged rotatably above the base. A hole for a falling coin is provided on the base. A rotational element turns the disk. A drive is arranged under the rotational element. A gear train is provided at the base for connecting the drive to the rotational element.

The gear train may also include a box opposite to the base.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 1:
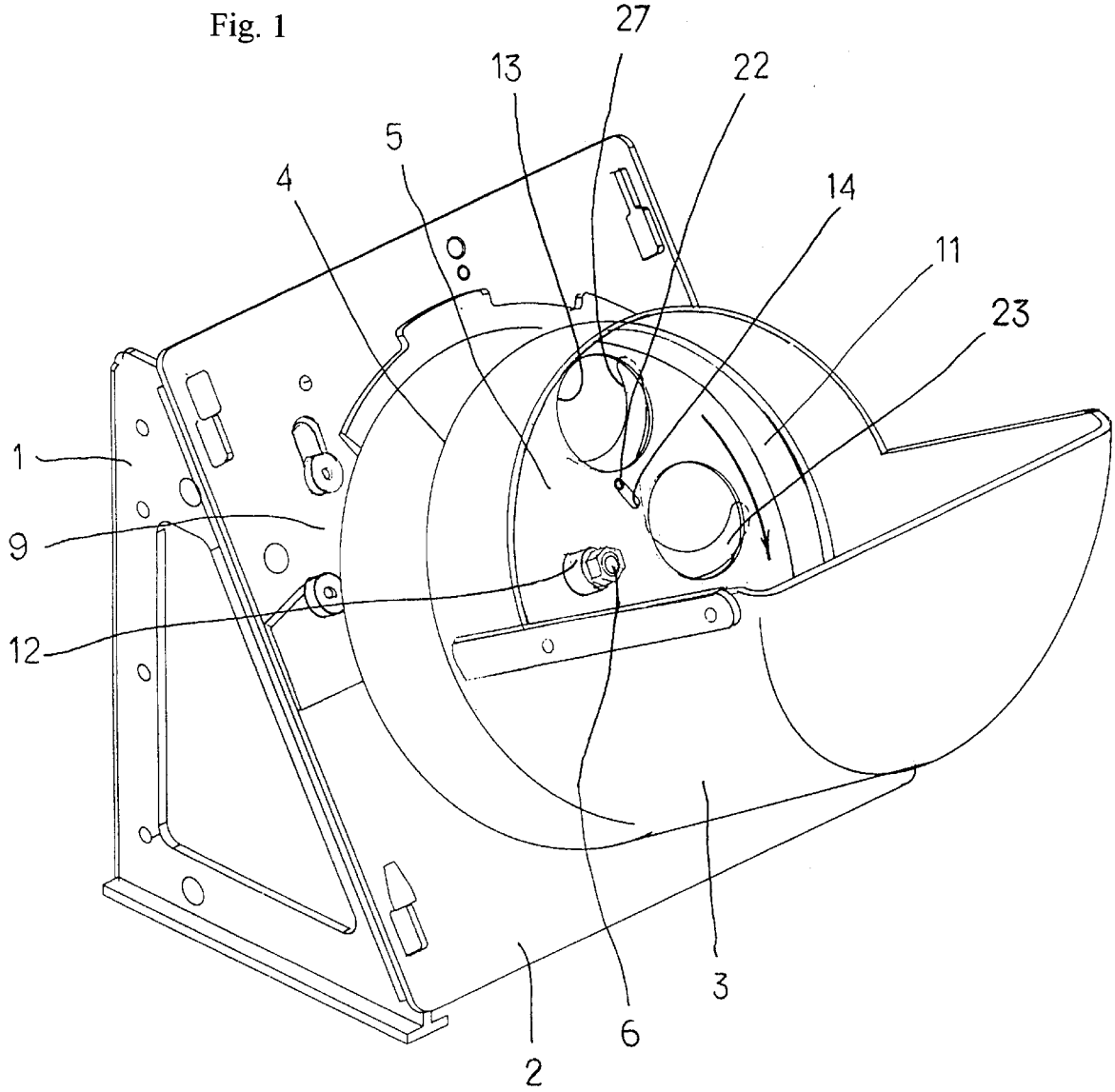
FIG. 1 is a perspective view showing a coin hopper according to one embodiment of the invention.

Referring to the drawings in particular, a pair of leg frames 1 form the hopper equipment that appears as a big triangle at the left in FIG. 1. On the pair of leg frames 1, a big square base board 2 is installed to be standing-up and inclined. At approximately the center in FIG. 1, a bowl-shaped tank 3 is provided. The end part of tank 3 is formed into a circular cylinder part 4 and is installed at the approximate center of base board 2. At the proper position between the base board 4 and the circular cylinder part 4, there is formed a release path 9 for coins. Inside the circular cylinder part 4 which is the bottom of tank 3, a disk 5 is mounted rotatably.

As shown in FIG. 1, the disk 5 is rotated in a clockwise direction, by a driving axle 6 in the center thereof The drive axis 6 is rotatably extends through the base board 2. The drive axle 6 is coupled to an electric motor (not shown), existing a gearbox (not shown) which is provided on the back of base board 2.

Figure 2:
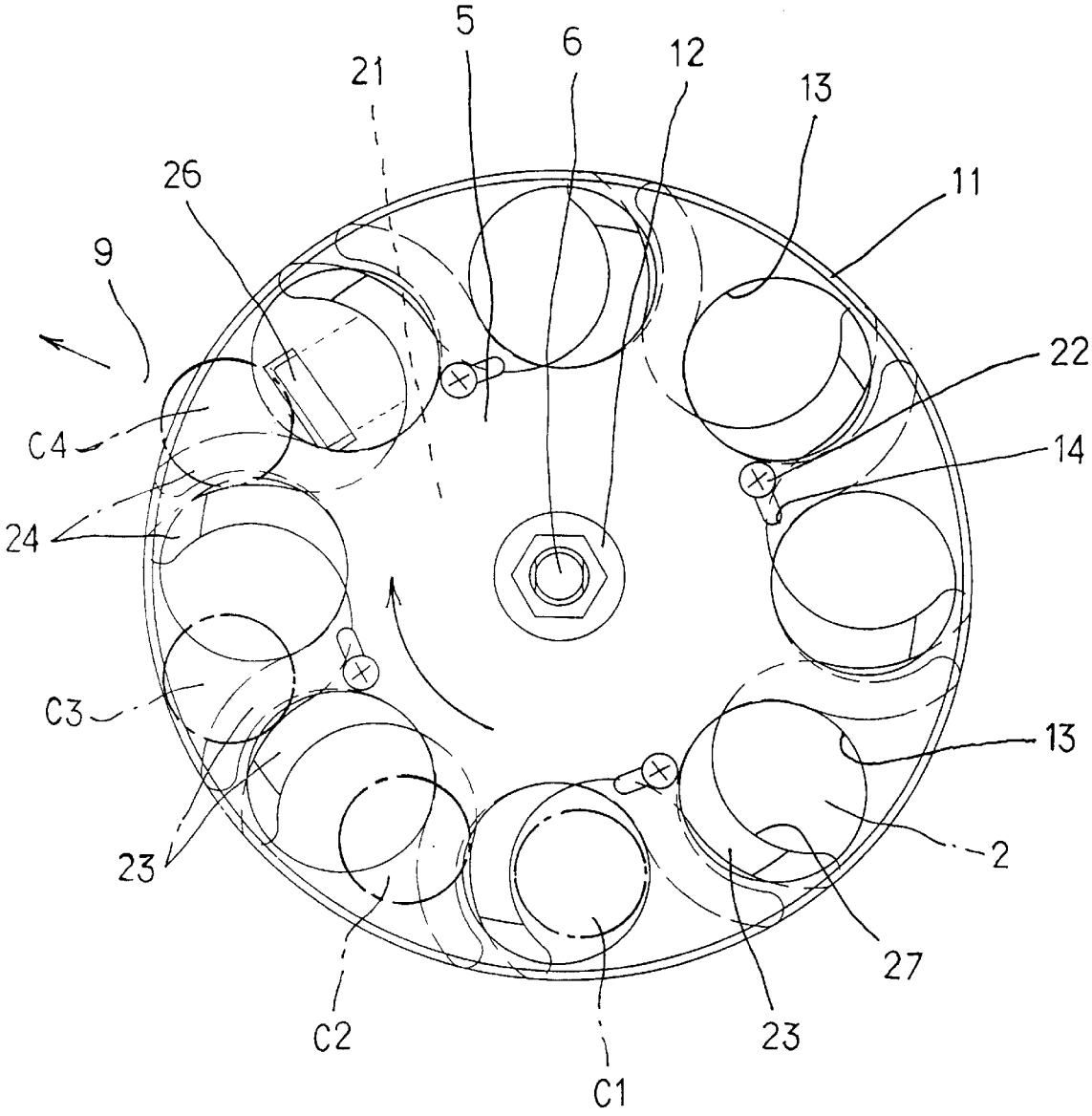
FIG. 2 is a top view showing the disk which is also shown in FIG. 1.
Figure 3:
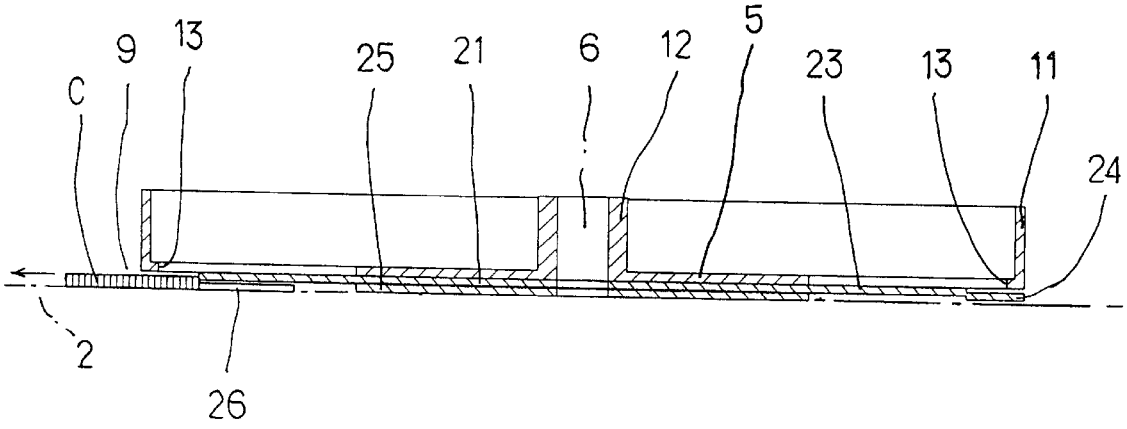
FIG. 3 is a side sectional view of the disk which shown in FIG. 2.

The disk 5 is formed with a little deep plate shape, as shown in FIGS. 2 and 3. An outwardly extending wall 11 is formed about the periphery of disk 5. At the center of disk 5, a pipe part 12 is formed which receives the drive axis 6.

In the whole peripheral side of disk 5, holes 13 are provided for falling coins. The holes 13 are formed at regular intervals. On the underside of disk 5, a generally gear-shaped adjustment board 21 is installed. The adjustment board 21 is rotatably mounted on the driving axle 6, at the center thereof The adjustment board 21 is mounted on the disk 5 by screws 22 which are provided in small slender holes 14 of disk 5 (see FIG. 2). Therefore, as for the adjustment hole 27 which is formed by the pass through hole 13 and the tooth part 23 of adjustment board 21, the size thereof can be easily changed. Further, the tip part 24 at each of curved slender tooth parts 23 of adjustment board 21 is bent slightly below. This is for the coin to be surely pressed by the tip part 24. Also, a spacer 25 with a little small circular board shape is arranged between the base board 2 and adjustment board 21 (see FIG. 3). At the base board 2 near the coin release path 6, the guide board 26 for coins is arranged. The height of spacer 25 is of course a little bit higher than the guide board 26(see FIG. 3). The guide board 26 is a small rectangular steel plate and the tip thereof is bent a little bent in an upper slant. The bent part of guide board 26 is installed to protrude from the surface of base board 2. The guide board 26 is installed on the underside of base board 2 with a bolt (not shown), existing a spring (not shown). When the disk 5 is turned in the positive turn, i.e., in the clockwise direction, the guide board 26 guides coins to the direction of release path 9 at the standing-up surface. When the disk 5 is turned in the reverse turn, i.e., to the direction of counterclockwise, coins can ride over the guide board 26 by the working of slope and spring.

This embodiment which consists of the above-mentioned constitution stores a plurality of identical coins kinds in a loose loading condition in the tank 3, and the electric motor (not shown) is driven. When the electric motor is driven, as shown in FIG. 2, the disk 5 is turned. A coin C1 falls into the pass through hole 13 when the disk 5 is turned. When the coin C1 which fell into the pierced hole 13 is smaller than the adjustment hole 27 which was formed by the tooth part 23, the coin C1 can ride on the surface of base board 2. Coins C2 and C3 which ride on the surface of base board 2 slide by the tooth part 23 which is fixed on the turning disk 5. A coin C4 which is slides is guided with the inside wall of circular cylinder part 4 of tank 3. Further, the sliding coin C4 is guided by the guide board 26 and sent out to the release path 9. Therefore, coins which are bigger than the adjustment holes 27 are never sent out to the release path 9. Even if a coin with big size is mixed into the coins C1 C4 which are a fixed size, the big size coin is never released from the hopper equipment.

When changing the size of coin in this embodiment, the adjustment board 21 is turned a little. For example, when changing into the bigger coin, the adjustment board 21 is turned a little to the direction of counterclockwise in FIG. 2. Loosening four screws 22 and turning the adjustment board 21 a little to the direction of counterclockwise results in the disk 5 again being fixed with the screws 22. Also, in the embodiment of FIG. 1, the disk 5 is almost in the standing up condition. However, putting the disk 5 in a level condition or an inclination condition a little is permitted of course. According to the embodiment of FIG. 1, the hopper of the type which slides a coin in a near standing-up condition is provided. However, this invention can also be applied to a hopper of the type which slips a coin levelly, too, of course. Also, the disk 5 of the drawing has the outwardly extending wall 11. However, the standing-up wall 11 is not always necessary. A thicker circular board is permitted to be used of course. Also, the size of the holes 13 is determined considering the coin maximum size of course. Also, in this implementation example, the adjustment board 21 is made a rough cogwheel form. However, using a circular board with serration form is permitted to of course. Depending on the number of holes 13, for example, in case of three holes, an adjustment board with an abbreviated triangle shape can be used of course. Further, making each adjustment board for each tooth part 23 and installing every hole 13 respectively is permitted of course. Also, in this example, the adjustment board 21 is mounted on the underside of disk 5. However, mounting the install adjustment board 21 on the surface of disk 5 is of course also possible. Also, in case of the example, the installation structure of disk 5 and adjustment board 21 is slender holes 14 and screws 22. However, using the driving axle 6, it is of course permitted to provide the fixation. When the disk 5 and adjustment board 21 are small, the use of driving axle 6 is favorable.

The invention has allows various coin sizes to be simply applied with only one coin hopper.

Figure 4:
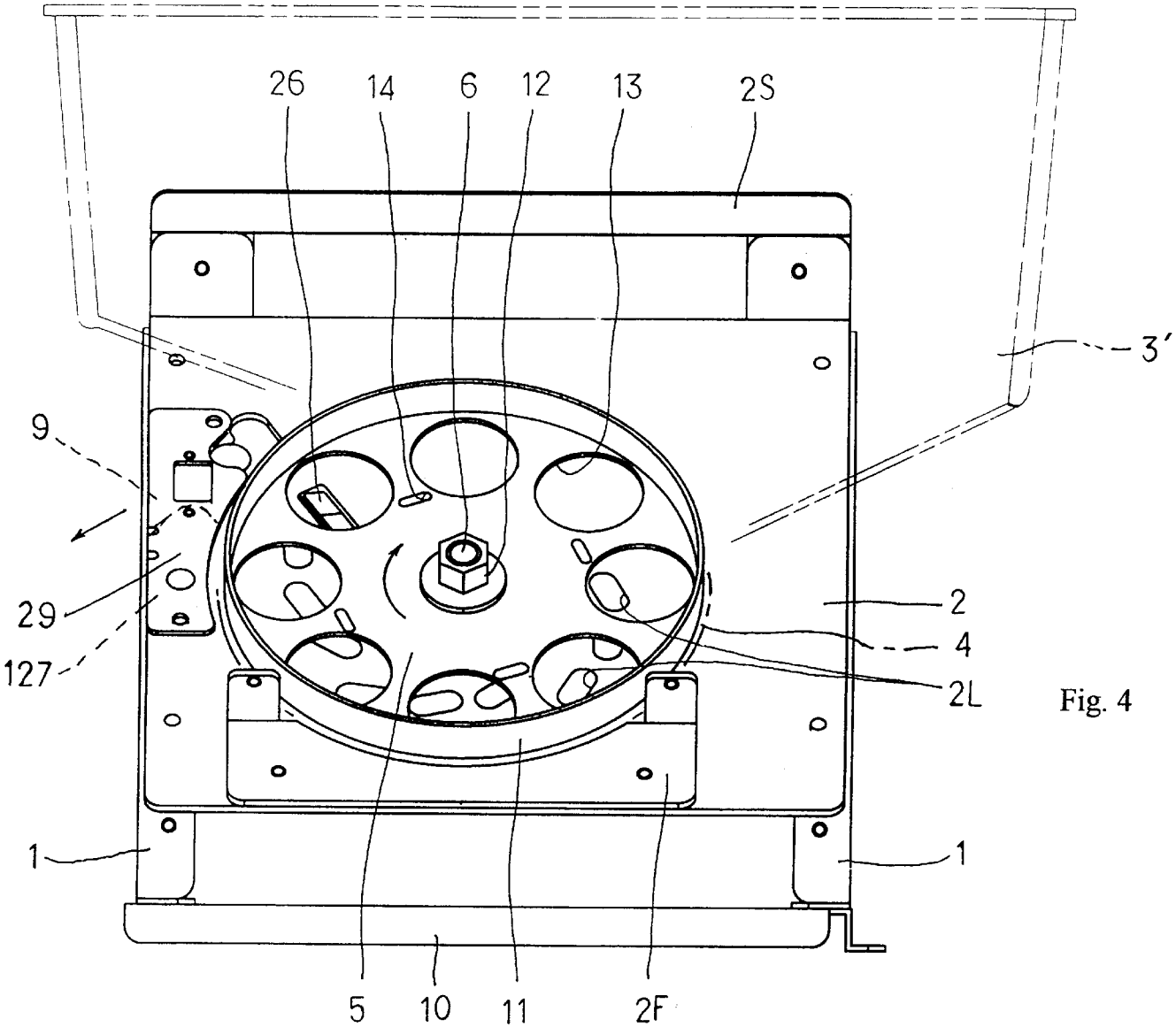
FIG. 4 is a front view showing roughly a coin hopper equipment of another embodiment according to the invention.

According to the embodiment of FIGS. 4–8 a base stand 10 of the coin hopper equipment is provided (lower part of FIG. 4). This base stand 10 includes an approximately square board, and the three sides are bent below and formed to legs for three point support. Leg frames 1 are in the standing-up and fixed on either side surface of base stand 10 respectively. A pair of these leg frames 1 become a right angle triangle approximately and are arranged at each side. Then, on one pair of leg frames 1, a big approximately square base board 2 is installed to be standing-up and inclined position. At suitable places of the base board 2, a plurality of openings are formed. For example, a plurality of length holes 2L which are opened in the lower part of base board 2 are used for making dust and so on fall. On the lower edge part of base board 2, a fixed board 2F for mounting a tank 3' (see below) is provided. Also, on the upper edge part of base board 2, a slender support board 2S for holding the tank 3' with the hook is arranged. The support board 2S is provided slidably in an up-down direction and fixably. A mark 3' which is shown by the chain line at the upper portion of FIG. 4 is the tank for coin accommodating. This tank 3' is made as a synthetic resin formed product with big square trumpet shape. The end part of tank 3' is formed into a circular cylinder part 4 and is installed at the approximate center of base board 2. The circular cylinder part 4 at its inside, which is the bottom of tank 3, has a disk 5 mounted rotatably. The disk 5 is formed with a little deep plate shape, as shown in FIG. 4. An outwardly extending wall 11 is formed along the whole limb of disk 5. The top surface of standing-up wall 11 is diagonally formed with in a manner that coins do not ride on (see FIG. 6). In the whole peripheral side of disk 5, holes 13 for falling coins are formed at regular intervals.

Figure 5:
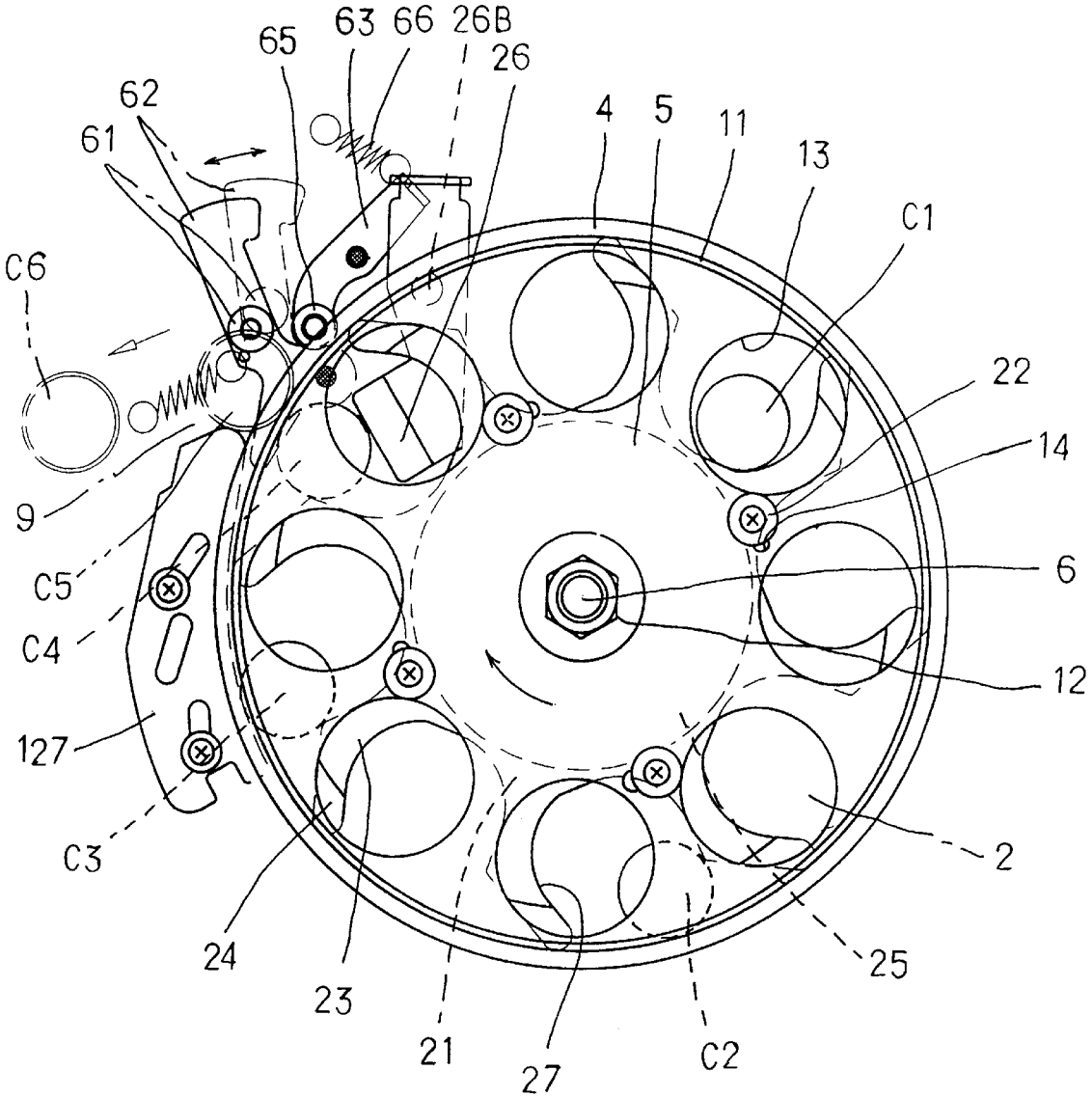
FIG. 5 is a top view showing roughly the disk which is the main part of FIG. 1.
Figure 6:
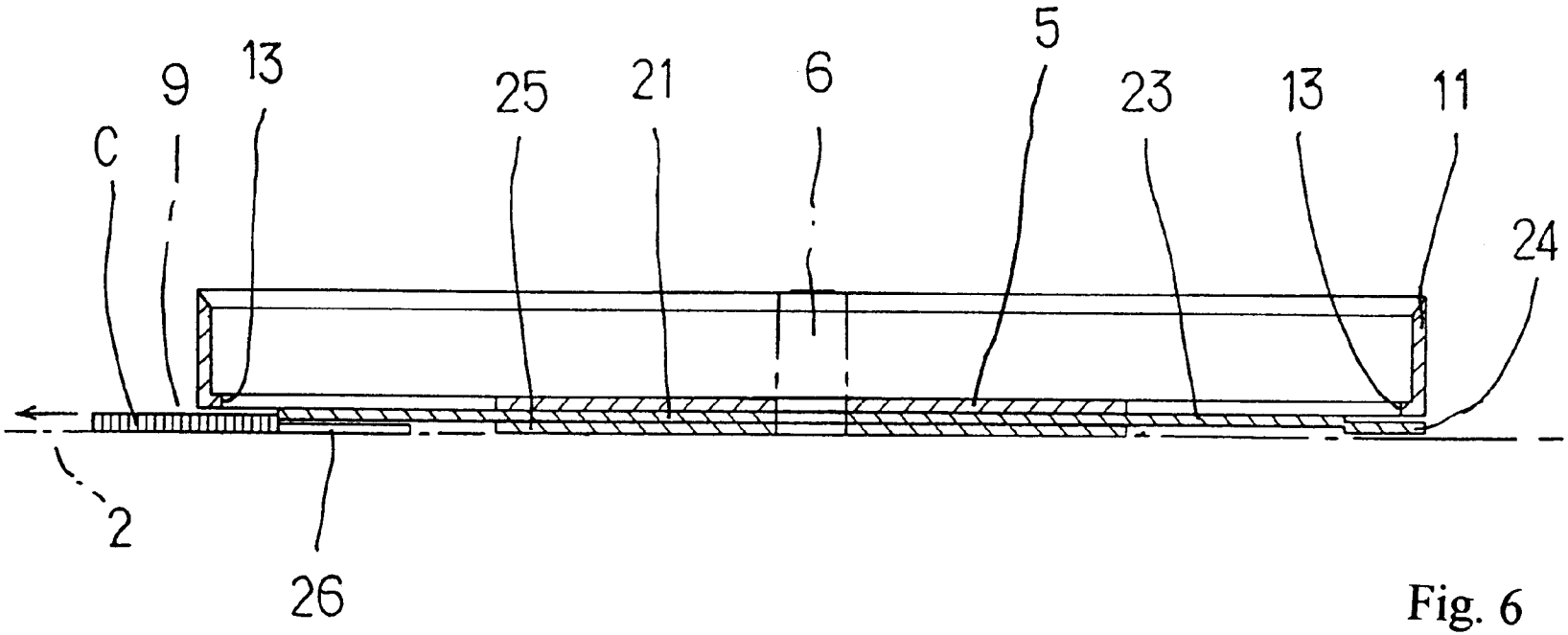
FIG. 6 is a side sectional view of the disk shown in FIG. 5.
Figure 7:
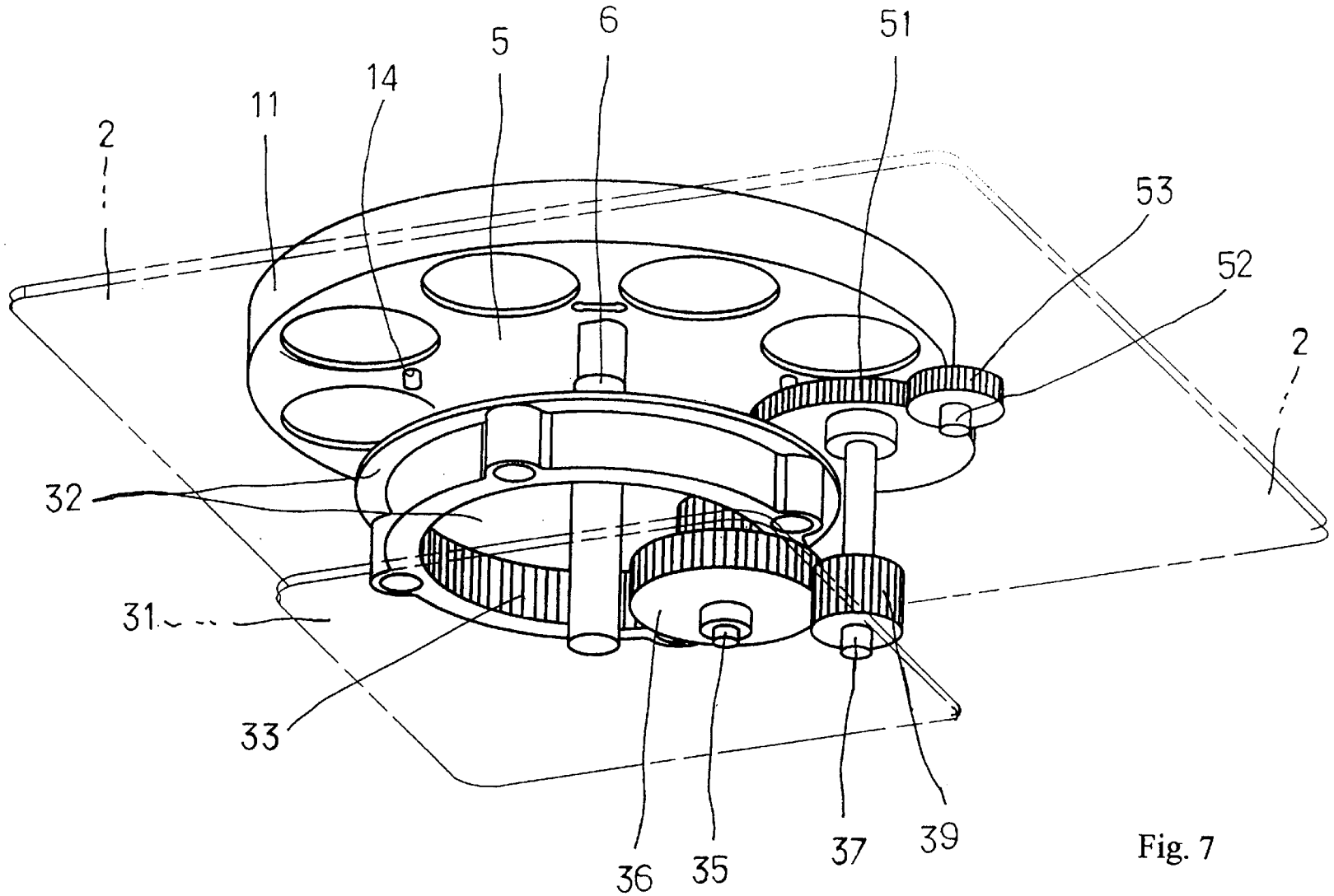
FIG. 7 is a bottom perspective view showing the drive part of a part shown in FIG. 4.

The disk 5 is rotated in a clockwise direction, as shown in FIG. 4, by a driving axle 6 in the center thereof On the underside of disk 5, a generally gear-shaped adjustment board 21 is installed (see FIG. 5). The adjustment board 21 is rotatably mounted on the driving axle 6, at the center thereof The adjustment board 21 is mounted on the disk 5 by screws 22, existing small slender holes 14 of disk 5 (see FIG. 5). Therefore, as for the adjustment hole 27 which was formed by the hole 13 and the tooth part 23 of adjustment board 21, the size thereof can be easily changed (see FIG. 5). Further, the tip part 24 at each of curved slender tooth parts 23 of adjustment board 21 is preferably bent a little below (see FIG. 6). This is to surely be pressed by the tip part 24. Also, a spacer 25 with a little small circular board shape is arranged between the base board 2 and adjustment board 21 (see FIG. 6). A part at the lower edge of circular cylinder part 4 is cut and the vent (not shown) for coins is formed. A release path 9 for coins which is communicates to the vent is formed on the base board 2.

At the base board 2 near the coin release path 6, the guide board 26 for coins is arranged. The height of spacer 25 is a little bit higher than the guide board 26(see FIG. 6). The spacer 25 may be more than one sheet. The guide board 26 is a rough L-shaped steel plate and the tip thereof is a little bent in an upper slant. The bent part of guide board 26 is installed to protrude from the surface of base board 2. The guide board 26 is installed on the underside of base board 2 with a bolt 26B. A spring (not shown) is covered on this bolt 26B and the spring is pushing the guide board 26 to the base board 2. Further, when the disk 5 is turned in the positive turn, i.e., to the direction of clockwise, the guide board 26 guides coins to the direction of release path 9 at the small standing-up surface. Then, when the disk 5 is turned in the reverse turn, i.e., to the counterclockwise direction coins can ride over the guide board 26 by the operation of the slope and the spring.

Figure 8:
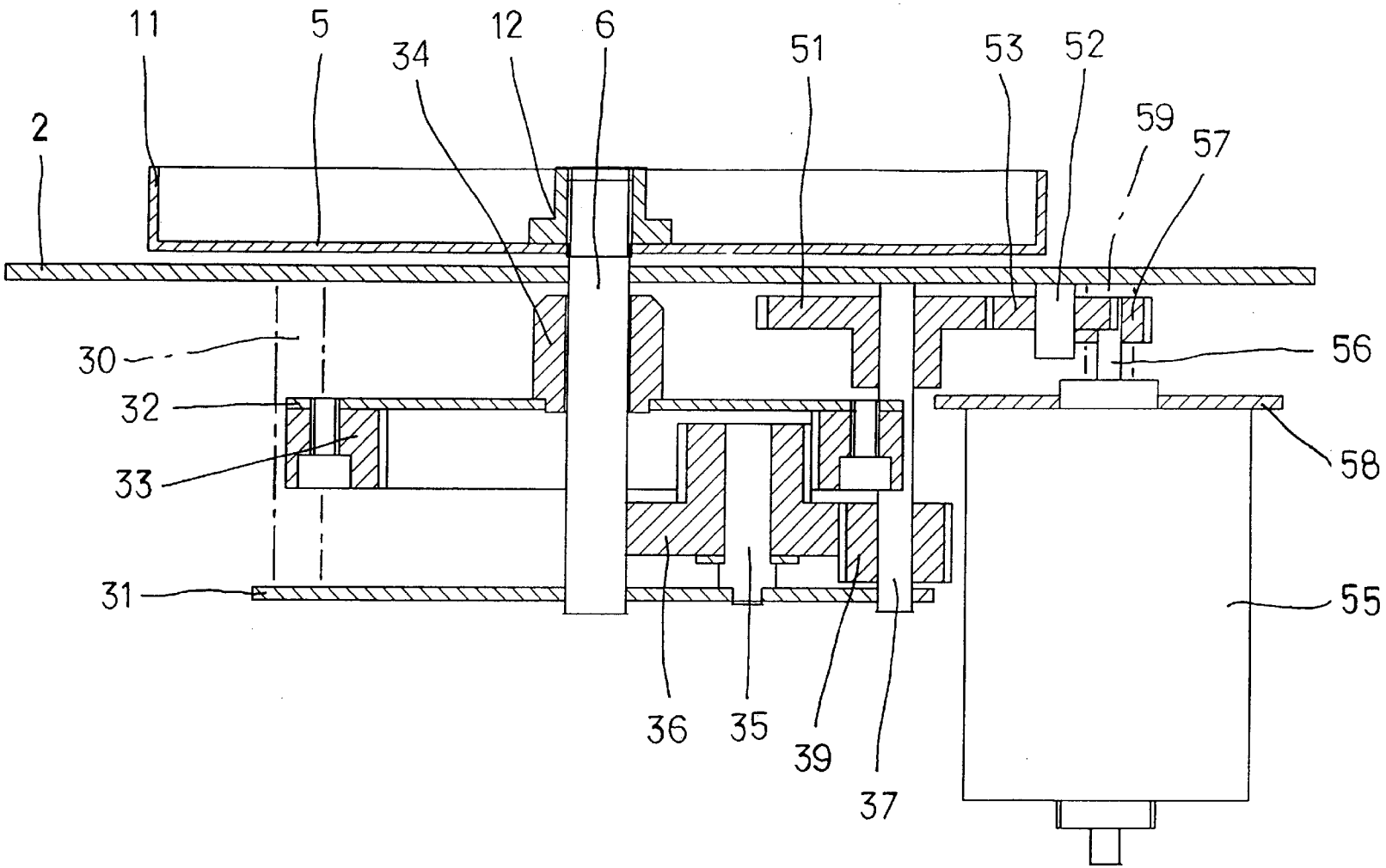
FIG. 8 is a front sectional view showing the drive part of FIG. 7.
Figure 10:
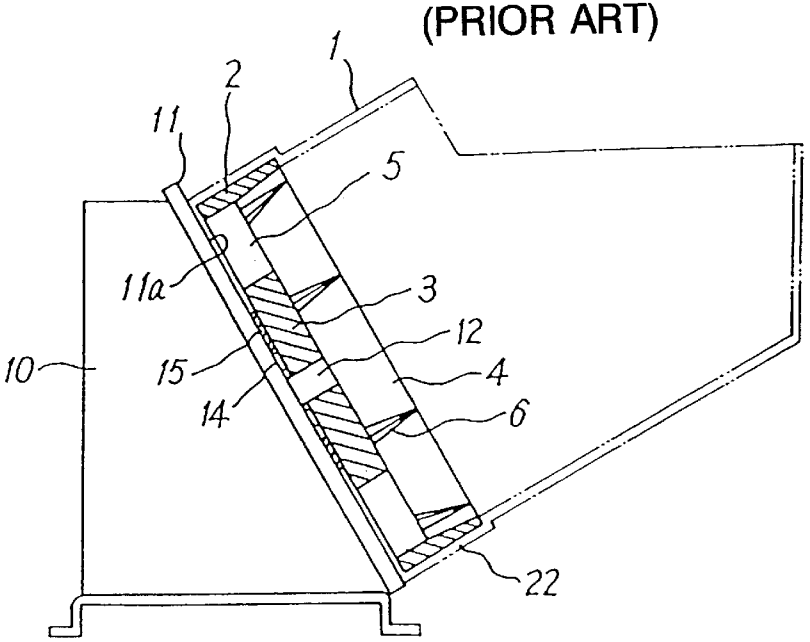
Fig. 10 (PRIOR ART)
FIG. 10 is a side sectional view which shows the device of FIG. 9.
Figure 9:
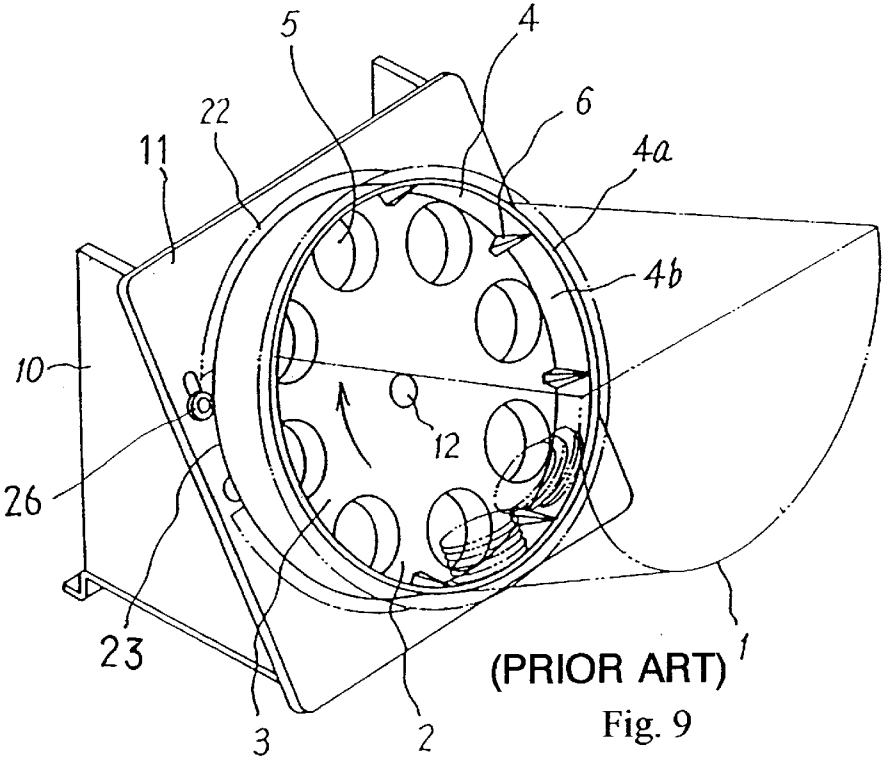
(PRIOR ART) Fig. 9
FIG. 9 is a perspective view of a prior art device.
Figure 11:
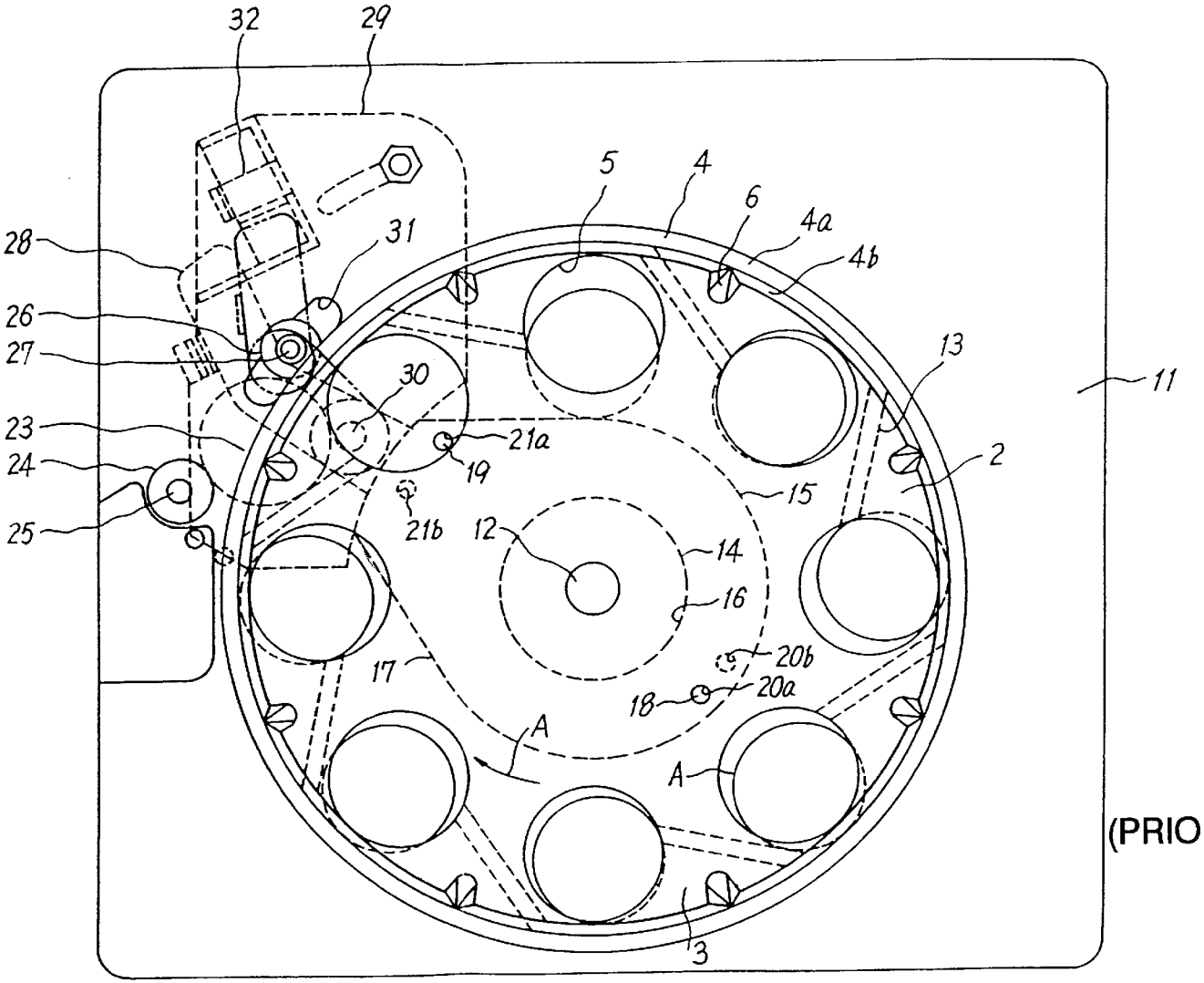
(PRIOR ART) Fig. 11
FIG. 11 is an enlarged sectional end view which shows the device of FIG. 9 from the top front.

A large column as shown at the right side of FIG. 8 is an electric motor 55. On the upper end part of drive axis 56 which penetrates the electric motor 55, a pinion 57 is positioned and is fixed. The column-shaped electric motor 55 is fixed at a diamond-shaped mounting board 58 with screws and so on. This mounting board 58 is fixed to stick-shaped short spacers 59 with screws and so on. The spacer 59 is fixed at the base board 2 with caulking or the like. A small fixed axis 52, too, is fixed at the base board 2 by caulking or the like.

A small plain gear 53 is rotatably put on this fixed axis 52 without loosening. The upper end part of a little long turn axis 37 is mounted removably and rotatably at the base board 2. The bottom tip part of turn axis 37 is installed removably and rotatably at a little large box board 31. Then, on the turn axis 37, a big plain gear 51 and a small gear 39 are fixed, respectively. A fixed axis 35 in the center of FIG. 8 is fixed at the square box board 31 with adhesive or caulking or the like. Then, a stepped gear 36 is rotatably put on the fixed axis 35. The big gear part of stepped gear 36 is engaged with the small gear 39 at the bottom tip part of turn axis 37. Further, the box board 31 is fixed to long stick-formed spacers 30 with screws and so on. The spacer 30 is fixed at the base board 2 by adhesive, caulking or the like. Four spacers 30 hang down and are fixed to the base board 2. Each of four corner parts of box board 31 is mounted to each bottom tip part of four spacers 30 with screw, respectively. The upper end part of driving axle 6 which turns the disk 5 is formed into a bolt. The disk 5 is fixed on the driving axle 6 by a nut 12 with washer. The driving axle 6 of disk 5 is rotatably passes through the base board 2 and protrudes at the under surface of base board 2 (see FIG. 7). The sticking out end of driving axle 6 is rotatably pierced through the square box board 31. At the center of long driving axle 6, a little small circular board 32 is fixed as a boss 34. On the underside of circle board 32, an inside teeth gear 33 with a little big ring form is fixed by screws and so on. The internal gear 33 is meshed with the small gear part of stepped gear 36. When removing the nut 12 from the driving axle 6, the disk 5 can be removed from the driving axle 6. When removing the box board 31 from the four spacer 30, the driving axle 6 having the internal gear 33 can be taken out. The turn axis 37 which has the plain gear 51 and small gear 39 can be removed. Moreover, the stepped gear 36 can be removed from the fixed axis 35. The plain gear 53 can be removed from the fixed axis 52 by removing a screw and so on.

This embodiment stores a plurality of identical kinds of coins in a loose loading condition in the tank 3'. When the electric motor 55 is driven, as shown in FIG. 5, the disk 5 is turned. A coin C1 falls into the hole 13 when the disk 5 is turned. When the coin C1 which fell into the hole 13 is smaller than the adjustment hole 27 which was formed by the tooth part 23, the coin C1 can ride on the surface of base board 2.

A coin C2 which rode on the surface of base board 2 slides by the tooth part 23 which was fixed on the turning disk 5. The coin C2 which slides is guided with the inside wall of circular cylinder part 4 of tank 3'. Further, a coin C3 slides and is sent out from the cut out vent (not shown) at the circular cylinder part 4. Then, the coin C3 is led to the release path 9 by an arc-shaped guide 127 and then is sent out. A cover board 29 is covered with the guide 127 (see FIG. 4).

The coins which are bigger than the adjustment holes 27 are never sent out to the release path 9, of course. Even if a coin with big size is mixed into the coins which are a fixed size, the big size coin is never released from the hopper equipment. The coin which is led by the guide 127 and is sent to the release path 9 is generally discharged, being turned around the upper end of guide 127. A coin C5 which is sent to the release path 9 moves a roller 61 for coin calculation, resisting a spring. The movement of a little long hinge fragment 62 having the moved roller 61 is detected by a sensor (not shown). Incidentally, a mark C6 shows a perfect slipped out coin. The coin C4 which is not led by the guide 127 is sent to the release path 9 by the guide board 26.

A coin which rides over the guide board 26 tries to move to the outside direction. However, the coin is returned into the circular cylinder part 4 by a spring 66 acting on a roller 65 of a short hinge board 63. In addition, it sends out a coin smoothly that the front-edge of each tooth part 23, i.e., the front-edge of each tip part 24 is formed into a straight line.

Particularly by the making of the front-edge of tip part 24 as a straight line, the coin C5 which touched the roller 61 is sent out more smoothly without slipping at the tip part 24, than a curved line of the front edge of tip part 24.

When changing the coin size in this embodiment, the adjustment board 21 is turned a little in FIG. 5. For example, when changing to a large coin, the adjustment board 21 is turned a little to the clockwise direction FIG. 5. That is, loosening four screws 22 and turning a little the adjustment board 21 to the direction of clockwise, and subsequently fixing the disk 5 with the screws 22.

While specific embodiments of the invention have been shown and described in detail to illustrate the application of the principles of the invention, it will be understood that the invention may be embodied otherwise without departing from such principles.

What is claimed is:

1. A size changeable coin hopper comprising:

a tank for storing coins in a loose loading condition;

a disk which is arranged rotatably at the inside bottom of said tank, said disk having a plurality of holes, each of said holes being provided for allowing coins to fall therethrough; and an adjustment board adjacent to said disk to open and close the holes, for adjusting the hole size for various coin sizes.

2. The size changeable coin hopper according to claim 1, wherein said adjustment board is circular cogwheel shape.

3. The size changeable coin hopper according to claim 2, wherein the cogwheel shape includes a plurality of tooth parts, each tooth part opening and closing a respective one of said disk holes and forming an adjustable opening.

4. The size changeable coin hopper according to claim 1, wherein said adjustment board includes a plurality of generally radially extending elements, each element being movable over a corresponding said hole so as form an adjustable opening and to vary the size of said adjustable opening.

5. The size changeable coin hopper according to claim 2, wherein each of said plurality of generally radially extending elements has a curved edge.

6. Coin hopper equipment comprising:

a base;

a disk arranged rotatably above said base, the disk having a plurality of holes, each of said holes for passage of a coin therethrough;

a rotating element for turning the disk;

a drive means arranged under the rotating element;

a gear train provided adjacent to the base for connecting the drive to said rotating element; and an adjustment plate adjacent to said disk with adjustment plate portions movable relative to said disk and fixable relative to said disk said adjustment plate portions each respectively cooperating with one of said holes to form respective adjustment openings, each of said adjustment openings having a size which may be varied by moving said adjustment plate relative to said disk, thereby varying the extent said adjustment plate portions respectively close said disk openings, the size of said adjustment openings being set by fixing said adjustment plate relative to said disk.

7. The coin hopper equipment according to claim 6, wherein said gear train includes gear box opposite to said base.

8. The size changeable coin hopper according to claim 6, wherein said adjustment plate is circular cogwheel shape.

9. The size changeable coin hopper according to claim 8, wherein the cogwheel shape includes a plurality of tooth parts, each tooth part opening and closing the hole and forming an adjustable opening.

10. The size changeable coin hopper according to claim 6, wherein said adjustment plate portions are a plurality of generally radially extending elements, each element being movable over a corresponding said hole so as to vary the size of said adjustable opening.

11. The size changeable coin hopper according to claim 8, wherein each of said plurality of generally radially extending elements has a curved edge.

12. A coin hopper comprising:

a loose coin receiving tank for receiving coins in a loose loading condition;

a disk which is arranged rotatably at the inside bottom of said tank, said disk having a plurality of holes; and an adjustment element adjacent to said disk and movable relative to said disk and fixable relative to said disk said adjustment element having integral portions, each of said portions respectively cooperating with one of said holes to form respective adjustment openings, each of said adjustment openings having a size which may be varied by moving said adjustment plate relative to said disk, thereby varying the extent said adjustment plate portions respectively close said disk openings, the size of said adjustment openings being set by fixing said adjustment plate relative to said disk.

13. The coin hopper according to claim 12, wherein said adjustment element is a plate and said portions are generally radially extending portions of said plate, each of said radially extending portions being movable as part of said plate to vary the size of said adjustable opening.

14. The coin hopper according to claim 12, wherein said adjustment element is circular cogwheel shape.

15. The coin hopper according to claim 14, wherein the cogwheel shape includes a plurality of tooth parts, each tooth part opening and closing the hole and forming one of said adjustable openings.

16. The size changeable coin hopper according to claim 13, wherein each of said plurality of generally radially extending elements has a curved edge.

* * * * *